US009300065B2

(12) United States Patent
Yuan et al.

(10) Patent No.: US 9,300,065 B2
(45) Date of Patent: Mar. 29, 2016

(54) ELECTRICAL CONNECTOR ASSEMBLY HAVING COMBINATION INTERFACE

(71) Applicant: HON HAI PRECISION INDUSTRY CO., LTD., New Taipei (TW)

(72) Inventors: Wei Yuan, Shenzhen (CN); Yu-San Hsiao, New Taipei (TW); Shih-Wei Hsiao, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/252,797

(22) Filed: Apr. 15, 2014

(65) Prior Publication Data

US 2014/0308832 A1 Oct. 16, 2014

(30) Foreign Application Priority Data

Apr. 15, 2013 (CN) ..... 2013 2 0187372 U

(51) Int. Cl.

| | |
|---|---|
| ***H01R 3/00*** | (2006.01) |
| ***H01R 12/73*** | (2011.01) |
| *H01R 13/629* | (2006.01) |
| *H01R 13/6581* | (2011.01) |
| *H01R 27/02* | (2006.01) |

(52) U.S. Cl.

CPC ..... *H01R 12/732* (2013.01); *H01R 13/629* (2013.01); *H01R 13/6581* (2013.01); *H01R 27/02* (2013.01)

(58) Field of Classification Search

CPC .... H01R 12/71; H01R 12/722; H01R 12/732; H01R 24/58

USPC ..... 439/79, 607.23, 607.4, 607.36

See application file for complete search history.

(56) References Cited

U.S. PATENT DOCUMENTS

| | | | | |
|---|---|---|---|---|
| 6,619,984 | B2 * | 9/2003 | Liu | H01R 13/6594 439/607.4 |
| 6,932,646 | B2 * | 8/2005 | Sloey | H01R 13/6581 439/607.4 |
| 7,192,297 | B1 * | 3/2007 | Wu | H01R 12/592 439/353 |
| 7,510,406 | B2 * | 3/2009 | Dong | H01R 12/7011 439/79 |
| 7,651,343 | B2 * | 1/2010 | Zhu | H01R 12/7047 439/569 |
| 7,670,151 | B2 * | 3/2010 | Yang | H01R 12/7052 439/378 |
| 7,686,628 | B2 * | 3/2010 | Lino | H01R 43/0256 439/108 |

(Continued)

FOREIGN PATENT DOCUMENTS

| | | |
|---|---|---|
| TW | M313353 | 6/2007 |

*Primary Examiner* — Abdullah Riyami
*Assistant Examiner* — Nader J Alhawamdeh
(74) *Attorney, Agent, or Firm* — Wei Te Chung; Ming Chieh Chang

(57) ABSTRACT

An electrical connector includes an insulative housing defining a base portion, a mating port extending along a front-to-rear direction and a pair of guiding posts disposed at two opposite sides of the base portion, the mating port defining a front face perpendicular to the front-to-rear direction, the guiding post extending beyond the front face and defining upper and lower faces opposite in a vertical direction and an outer connecting face connecting the upper and lower faces. A plurality of conductive terminals are retained in the insulative housing and arrange in a longitudinal direction, and a shield shell enclosing the insulative housing. Each guiding slot defines a first guiding slot selectively disposed on at least one face of the upper and lower faces and the connecting face, and the first guiding slot is U-shaped and forwardly runs through a free end of the guiding post in the front-to-rear direction.

19 Claims, 11 Drawing Sheets

(56) References Cited

U.S. PATENT DOCUMENTS 7,726,983 B2 * 6/2010 Zhu ..... H01R 12/57 439/552
7,914,302 B1 * 3/2011 Zhu ..... H01R 13/41 439/79
7,946,887 B1 * 5/2011 Zhang ..... H01R 27/02 439/607.23
7,963,800 B1 * 6/2011 Chen ..... H01R 12/7047 439/607.27
7,985,080 B2 * 7/2011 Ai ..... H01R 12/712 439/570
7,993,161 B2 * 8/2011 Mao ..... H01R 12/7052 439/607.4
8,002,588 B1 * 8/2011 Zhu ..... H01R 12/712 439/660
8,007,289 B2 * 8/2011 Bandhu ..... H01R 13/6271 439/638
8,011,966 B1 * 9/2011 Tang ..... H01R 13/6461 439/638
8,727,796 B2 * 5/2014 Ngo ..... H01R 12/75 439/660
2007/0149006 A1 * 6/2007 Wu ..... H01R 12/721 439/78
2008/0003862 A1 * 1/2008 Yuan ..... H01R 12/716 439/350
2008/0176426 A1 * 7/2008 Zhu ..... H01R 12/721 439/79
2010/0035477 A1 * 2/2010 Yuan ..... H01R 12/79 439/638
2010/0317229 A1 * 12/2010 Chen ..... H01R 27/02 439/607.23
2011/0143597 A1 * 6/2011 Lee ..... H01R 12/7023 439/630
2011/0263162 A1 * 10/2011 Zhu ..... H01R 12/57 439/660
2012/0077389 A1 * 3/2012 Zhang ..... H01R 24/60 439/660
2012/0108109 A1 * 5/2012 Zhang ..... H01R 12/721 439/629

* cited by examiner

ELECTRICAL CONNECTOR ASSEMBLY HAVING COMBINATION INTERFACE

BACKGROUND OF THE INVENTION

1. Field of the Invention

The present invention relates to an electrical connector assembly, and more particularly to an electrical connector assembly with a combination interface.

2. Description of the Related Art

U.S. Pat. No. 7,946,887 issued on May 24, 2011 discloses an electrical connector assembly including a first connector and a second connector mating with each other. The first connector includes a longitudinal base and a plurality of contacts retained in the base. The base defines a mating tongue and a mating frame arranged side by side along the longitudinal direction, and a mating cavity is surrounded by the mating frame. The plurality of contacts are divided into a first contact set exposed upon a mating face of the mating tongue and a second contact set projecting into the mating cavity. The first connector has two connector interfaces arranged side by side which provides a complex connector benefit for miniaturization. However, the mating tongue is spaced from the mating frame with a gap provided therebetween, and the longitudinal base will be easily snapped in a portion corresponding to the gap. Moreover, the first contact set is arranged upon a single mating tongue, which is not benefit for excellent high-frequency characteristics, the poor guiding function between the first connector and the second connector is not benefit for mating the electrical connector assembly.

Therefore, an improved electrical connector is highly desired to meet overcome the requirement.

BRIEF SUMMARY OF THE INVENTION

An object of the present invention is to provide an electrical connector assembly having an improved guiding function.

In order to achieve above-mentioned object, an electrical connector includes an insulative housing defining a base portion, a mating port extending along a front-to-rear direction and a pair of guiding posts disposed at two opposite sides of the base portion, the mating port defining a front face perpendicular to the front-to-rear direction, the guiding post extending beyond the front face and defining upper and lower faces opposite in a vertical direction and an outer connecting face connecting the upper and lower faces. A plurality of conductive terminals are retained in the insulative housing and arrange in a longitudinal direction, and a shield shell enclosing the insulative housing. Wherein each guiding slot defines a first guiding slot selectively disposed on at least one face of the upper face, the lower face and the connecting face, and the first guiding slot is U-shaped and forwardly runs through a free end of the guiding post in the front-to-rear direction.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
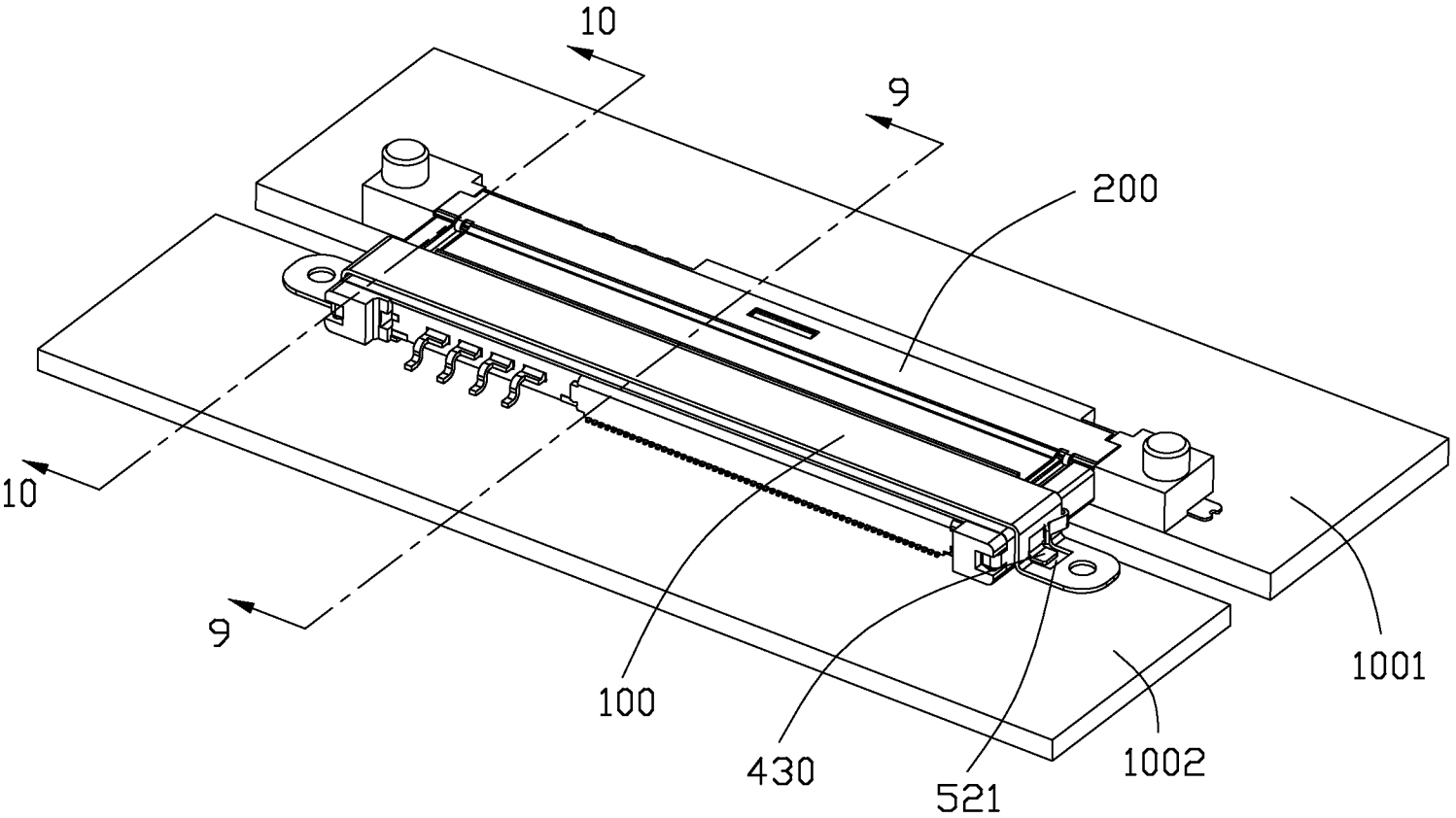
FIG. 1 is an assembled, perspective view of an electrical connector assembly including an electrical connector and a mating connector in accordance with the present invention.
Figure 2:
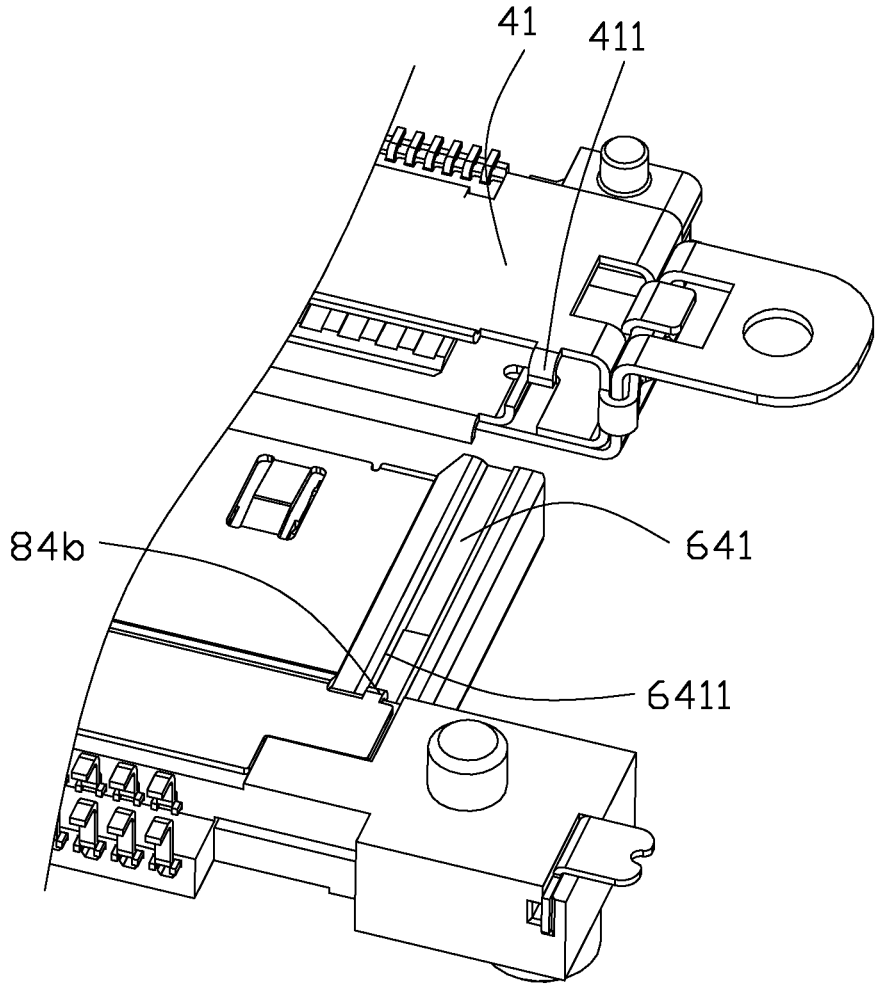
FIG. 2 is an enlarged perspective view of a part of the electrical connector assembly.

Reference will now be made to the drawing figures to describe a preferred embodiment of the present invention in detail. Referring to FIG. 1 and FIG. 2, an electrical connector assembly in accordance with the present invention includes an electrical connector 200, or a second connector, to be mounted onto a first printed circuit board 1001, and a mating connector 100, or a first connector, to be mounted onto a second printed circuit board 1002 for mating with the electrical connector 200.

Figure 3:
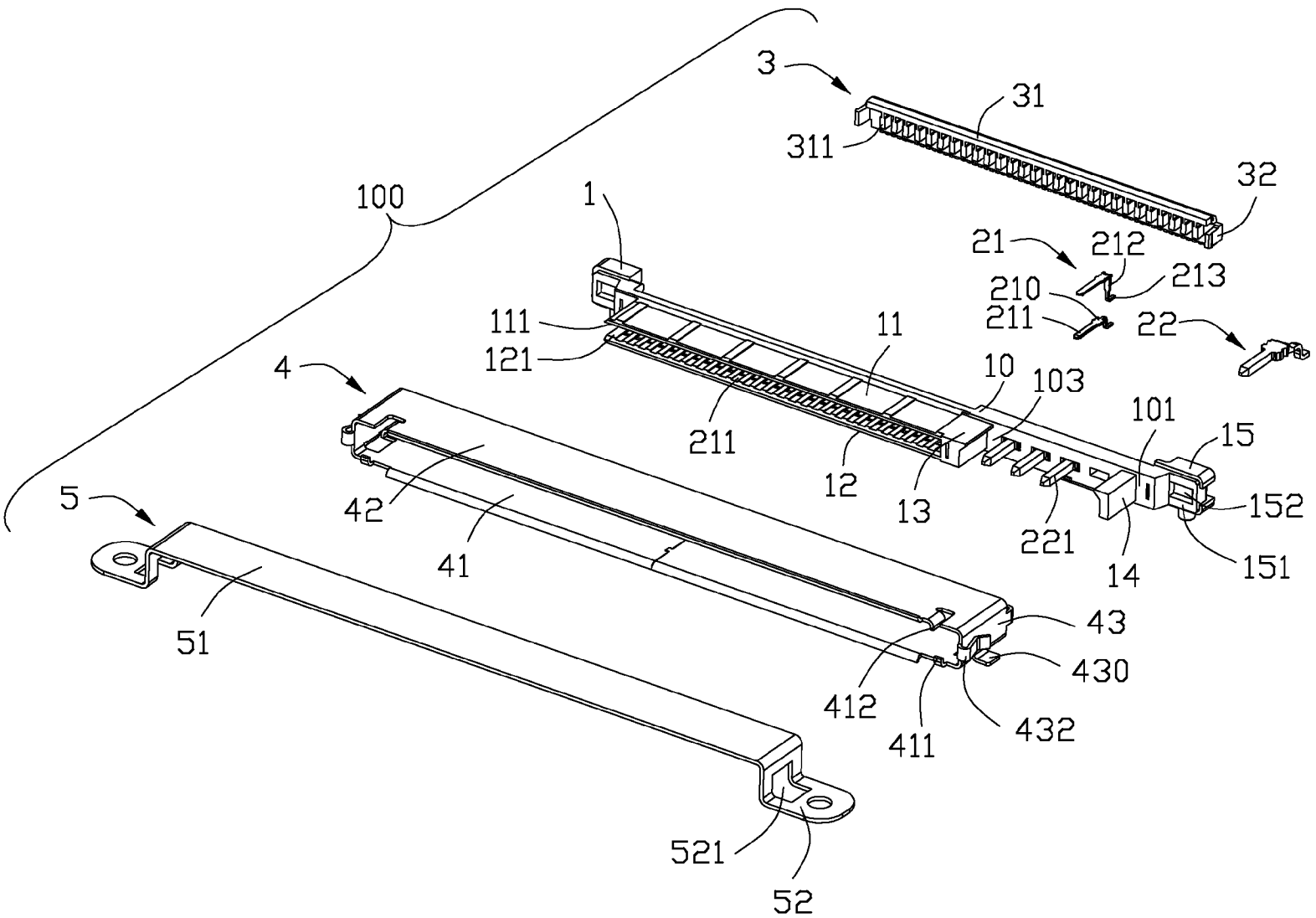
FIG. 3 is a partly exploded perspective view of the mating connector shown in FIG. 1.
Figure 4:
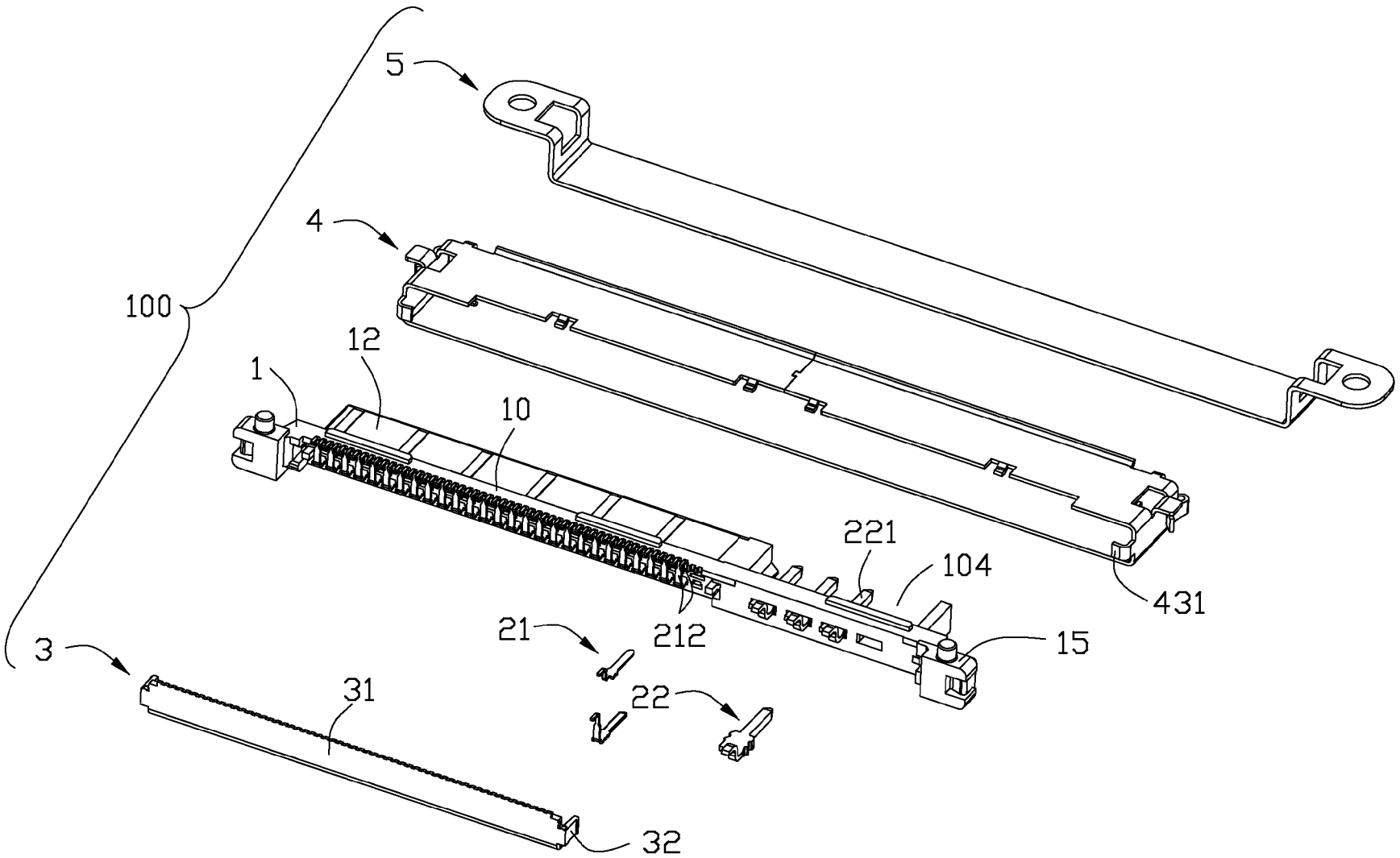
FIG. 4 is another partly exploded perspective view of the mating connector shown in FIG. 3.
Figure 5:
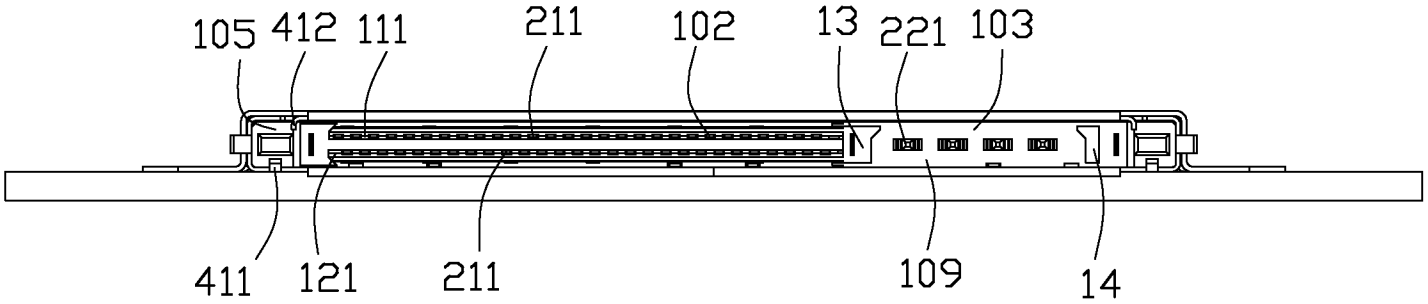
FIG. 5 is a front elevational view of the mating connector shown in FIG. 1.

Referring to FIG. 3 to FIG. 5, the first connector 100 includes an insulative first housing 1, a plurality of contacts arranged in the first housing 1, a spacer 3 retained to the first housing 1, a metal shell 4 enclosing the first housing 1, and a retaining member 5 attached to the metal shell 4.

The first housing 1 defines a longitudinal base portion 10, a mating portion extending forwardly from the base portion 10 along a front-to-rear direction and a pair of fixing portions 15 extending outwardly from two opposite ends of the base portion 10 along the longitudinal direction. The mating portion defines a first and a second mating tongue 11, 12 stacked with each other in a vertical direction perpendicular to both the longitudinal direction and the front-to-rear direction, and a first and a second strengthen arm 13, 14 projecting forwardly from the base portion 10 along the front-to-rear direction. The first and second mating tongues 11, 12 space from each other and provide opposite first and second mating faces 111, 121 facing to each other. The first and second strengthen arms 13, 14 space from each other and locate at a same side of the first and second mating tongues 11, 12, the first strengthen arm 13 integrally connect with both an end of the first mating tongue 11 and an end of the second mating tongue 12. The first and second mating tongues 11, 12 and the first and second strengthen arms 13, 14 extend from a front face 101 of the base portion 10. The fixing portions 15 extend from a rear face of the base portion 10, and each fixing portion 15 defines a stopping face 151 facing forwards and a receiving room 152 recessed rearwards from the stopping face 151 along the front-to-rear direction, the stopping face 151 is located behind the front face 151 in the front-to-rear direction.

The plurality of contacts are divided into a first contact set and a second contact set, each first contact 21 of the first contact set defines a first retaining portion 210, a stiff first contacting portion 211 extending forwards from the first retaining portion 210, a connecting portion 212 bending downwardly from a rear end of the first retaining portion 210, and a surface mounting type first soldering portion 213 extending from the connecting portion 212. The first contact set is arranged in the first housing 1 along the longitudinal direction with the first contacting portions 211 exposed upon both the first mating face 111 and the second mating face 121, and as best shown in FIG. 5, the first contacting portions 211 exposed upon the first mating face 111 are offset with that exposed upon the second mating face 121 in the longitudinal direction. The first contacts 21 of the first contact set extend out of the first housing 1 with the connecting portions 212 located in two rows and the first soldering portions 213 arranged in one row along the longitudinal direction. The second contacts 22 of the second contact set are arranged in the first housing 1 along the longitudinal direction with second contacting portions 221 disposed between the first and second strengthen arms 13, 14, second soldering portions of the second contact set extend out of the first housing 1.

The spacer 3 defines a main body portion 31 and a pair of latching arms 32 respectively disposed at two ends of the main body portion 31 and extending forwardly from the main body portion 31. The main body portion 31 provides a plurality of spaced partitions 311 in an inner surface thereof. The spacer 3 is assembled to a rear portion of the base portion 10 and to be retained behind the first and second tongue portion 11, 12 by the latching arms 32, each connecting portion 212 disposed in a rear row is disposed between two adjacent partitions 311. The spacer 3 is set for preventing the first contact set from dropping out rearwards and improving crosstalk between the connecting portions 212.

The metal shell 4 includes a first side wall 41, a second side wall 42 opposite to the first side wall 41, and a pair of end walls 43 connecting the first and second side walls 41, 42 at two ends thereof. A pair of first guiding portions 411 bends upwards from a front edge of the first side wall 41 at a portion adjacent to the end walls 43. A pair of second guiding portions 412 is ripped from the second side wall 42 at a portion adjacent to the end walls 43 and projects to the first side wall 41. The first and second guiding portions 411, 412 offset in the longitudinal direction and respectively disposed in two perpendiculars planar. The metal shell 4 is retained to the first housing 1 by the latching portions 431 locking to the fixing portion 15.

The retaining member 5 for retaining the first connector 100 in the first printed circuit board 1002 includes a board portion 51 and a pair of soldering legs 52 bending downwardly from two opposite ends thereof, each soldering leg 52 defines through hole 521 thereof. The retaining member 5 is assembled to the metal shell 4 and clipped by resilient arms 432 of the metal shell 4, the board portion 51 attaches to the first side wall 41. Each soldering leg 52 is disposed outside of the end walls 43 with the connecting legs 430 disposed in the through hole 521.

Referring to FIG. 5, the metal shell 4 encloses the first housing 1 with the base portion 10, the first and second mating tongues 11, 12, the first and second strengthen arms 13, 14 and the fixing portions 15 disposed in a mating cavity 109. The first and second mating tongues 11, 12 are disposed in the mating cavity 109 to provide a first mating port 102, and the first and second strengthen arms 13, 14 are disposed in the mating cavity 109 to provide a second mating port 103 therebetween. The second mating port 103 defines a mating room 104 disposed between the first and second strengthen arms 13, 14, and the second contacting portions 221 project into the mating room 104. The first strengthen arm 13 integrally connect with both an end of the first mating tongue 11 and an end of the second mating tongue 12 to connect the first and second mating ports 102, 103, which can improve the rigidity of the first connector 100. The first contacting portions 211 of the first contact 21 are located on the first and second mating faces 111, 121, respectively, to increase the spacing between the first contacts 21, which is conducive to reduce the signal interference of the first contact 21. A guiding room 105 is provided in front of each fixing portion 15, and the first and second guiding portions 411, 412 project into the guiding room 105.

Figure 6:
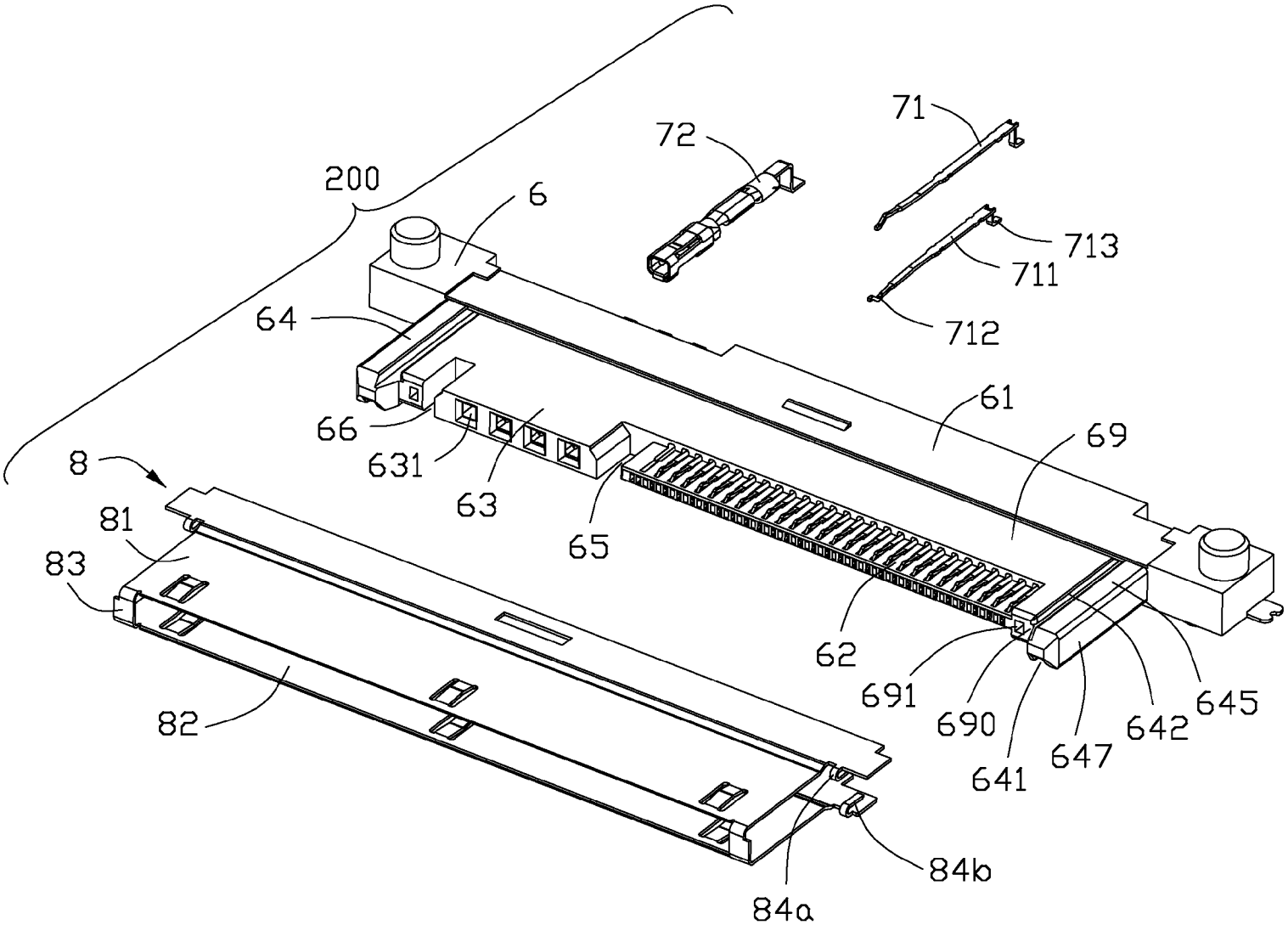
FIG. 6 is a partly exploded perspective view of the electrical connector shown in FIG. 1.
Figure 7:
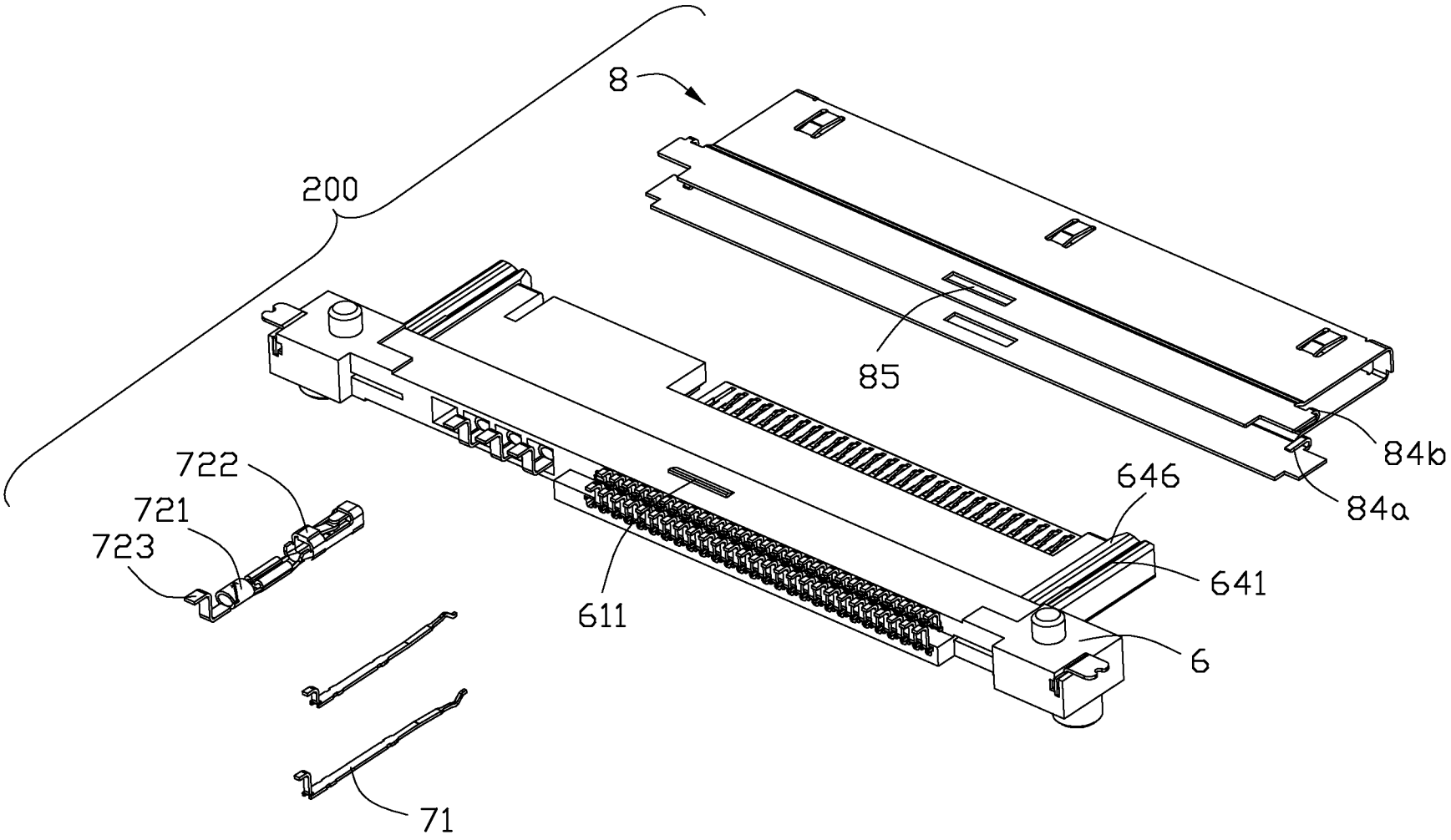
FIG. 7 is another partly exploded perspective view of the electrical connector shown in FIG. 6.
Figure 8:
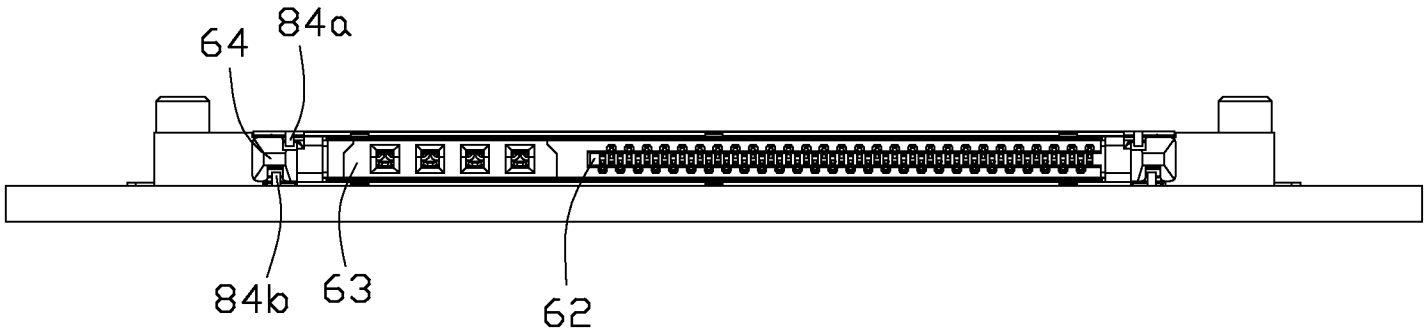
FIG. 8 is a front elevational view of the electrical connector shown in FIG. 1.

Referring to FIG. 6 to FIG. 8, the second connector 200 includes a second insulative housing 6, a plurality of mating contacts retained to the second housing 6, and a mating shield shell 8 attached to the second housing 6.

The second housing 6 defines a second base portion 61, a third mating port 69 extending forwards from the second base portion 61, and a pair of guiding posts 64 disposed at two opposite sides of the third mating port 69. The third mating portion 69 defines a front face 690 facing forwards, the guiding posts 64 forwardly project beyond the front face 690. Each guiding post 64 defines an upper face 645, a lower face 646 opposite to the upper face 645, and an outer connecting face 647 connecting the upper face 645 and the lower face 646. The height of the guiding post 64 is larger than the height of the third mating port 69, the larger guiding post 64 is co-ordination with the guiding room 105, which has a good guiding function without increasing the overall size of the electrical connector. The third mating port 69 includes a first mating portion 62 and a second mating portion 63 arranged side by side in the longitudinal direction. A first receiving slot 65 is provided between the first mating portion 62 and the second mating portion 63, a second receiving slot 66 is provided adjacent to the second mating portion 63. Each guiding post 64 defines a first guiding slot 641 in the upper face 645 and a second guiding slot 642 in the lower face 646, the first and second guiding slots 641, 642 both extend in the front-to-rear direction and offset with each other in the longitudinal direction. A plurality of receiving grooves arrange in two opposite longitudinal faces of the first mating portion 62, the second mating portion 63 defines a plurality of terminal holes 631 therein. In other embodiment, the first guiding slot 641 can be disposed on the connecting face and the second guiding slot is disposed on junction between the guiding post 64 and the third mating port 69. In summary, the first guiding slot 641 is disposed on one of the upper face, lower face and connecting face of the guiding post 34, the first guiding slot 641 is running through the free end of the guiding post or the mating end of the mating portion and the first guiding slot 641 is U-shaped which is conductive to correctly aligned of the first guiding portion 411 of the first connector.

The mating contacts include a plurality of first mating contacts 71 and a plurality of second mating contacts 72. Each first mating contact 71 defines a stiff first securing portion 711, a resilient contacting arm 712 extending forwards from the first securing portion 711, and a first connecting end 713 extending from a rear portion of the first securing portion 711. Each second mating contact 72 defines a second securing portion 721, a clipping portion 722 extending forwardly from a front end of the second securing portion 721, and a second connecting end 723 extending from a rear portion of the second securing portion 721. The first mating contacts 71 arrange in two rows to be retained in the second base portion 61, the resilient contacting arms 712 are received in the receiving grooves to expose upon two opposite longitudinal faces of the first mating portion 62, the first connecting ends 713 extend out of the second base portion 6 to arrange in two rows. The second mating contacts 72 are retained in the second base portion 6 with the clipping portions 722 received in the terminal holes 631, the second connecting ends 723 extend out of the second base portion 6 and arrange in one row.

The mating shell 8 includes opposite first and second base plates 81, 82, and two connecting plates 83 connecting the front edges of the first and second base plates 81, 82 at two side portion thereof. The first and second base plates 81, 82 are located on opposite sides of the third mating port, respectively. The mating shell 8 defines first and second locking portions 84*a*, 84*b* bending to the second base portion 61, and the first and second locking portions 84*a*, 84*b* slide in corresponding first and second guiding slots 641,642 to be fixed to the base portion 61 and offset with each other in the longitudinal direction. The connecting plate 83 is abut against the front face 690 and adjacent to the guiding post 64, and the front face 690 defines two holes 691 corresponding to the connecting plate 83 and running through the front face 690, which is conducive to the molding of the insulative housing 6. The part of the guiding post 64 located in front of the front face 690 is a tapered shaped. The mating shell 8 are rearwards assembled to the second housing 6, the first locking portion 84*a* slides in second guiding slot 642 and the second locking portion 84*b* slides in the first guiding slot 641 until the first and second locking portions 84*a*, 84*b* latching with the second housing 6, which can guide the mating shell 8 assembled to the second housing 6 smoothly. The latching holes 85 disposed in the first and second base plates 81, 82 latch with the protrusions 611 to improve the retaining between the mating shell 8 and the second housing 6.

Figure 9:
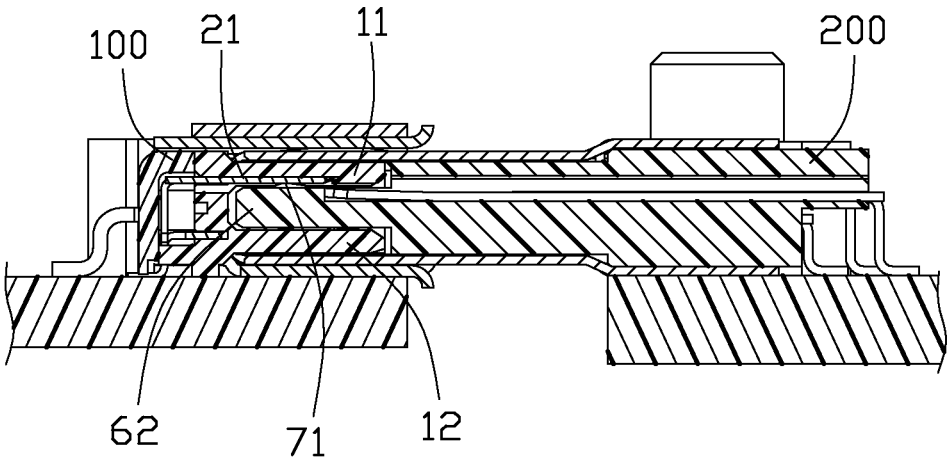
FIG. 9 is a cross-section view of the electrical connector assembly taken along line 9-9 of FIG. 1.
Figure 10:
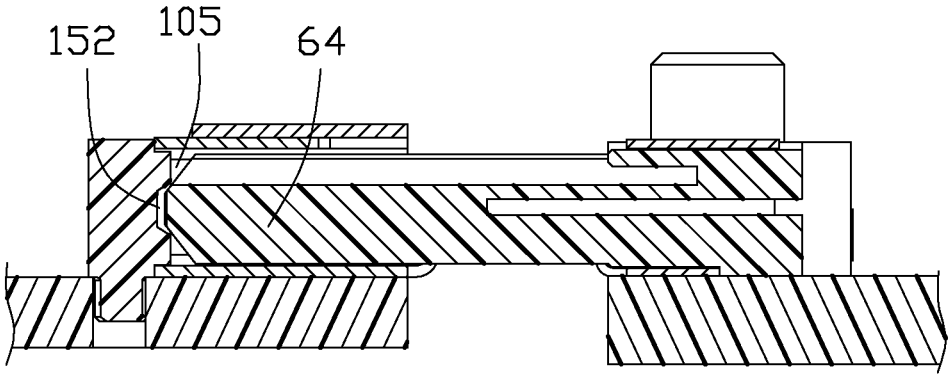
FIG. 10 is a cross-section view of the electrical connector assembly taken along line 10-10 of FIG. 1.
Figure 11:
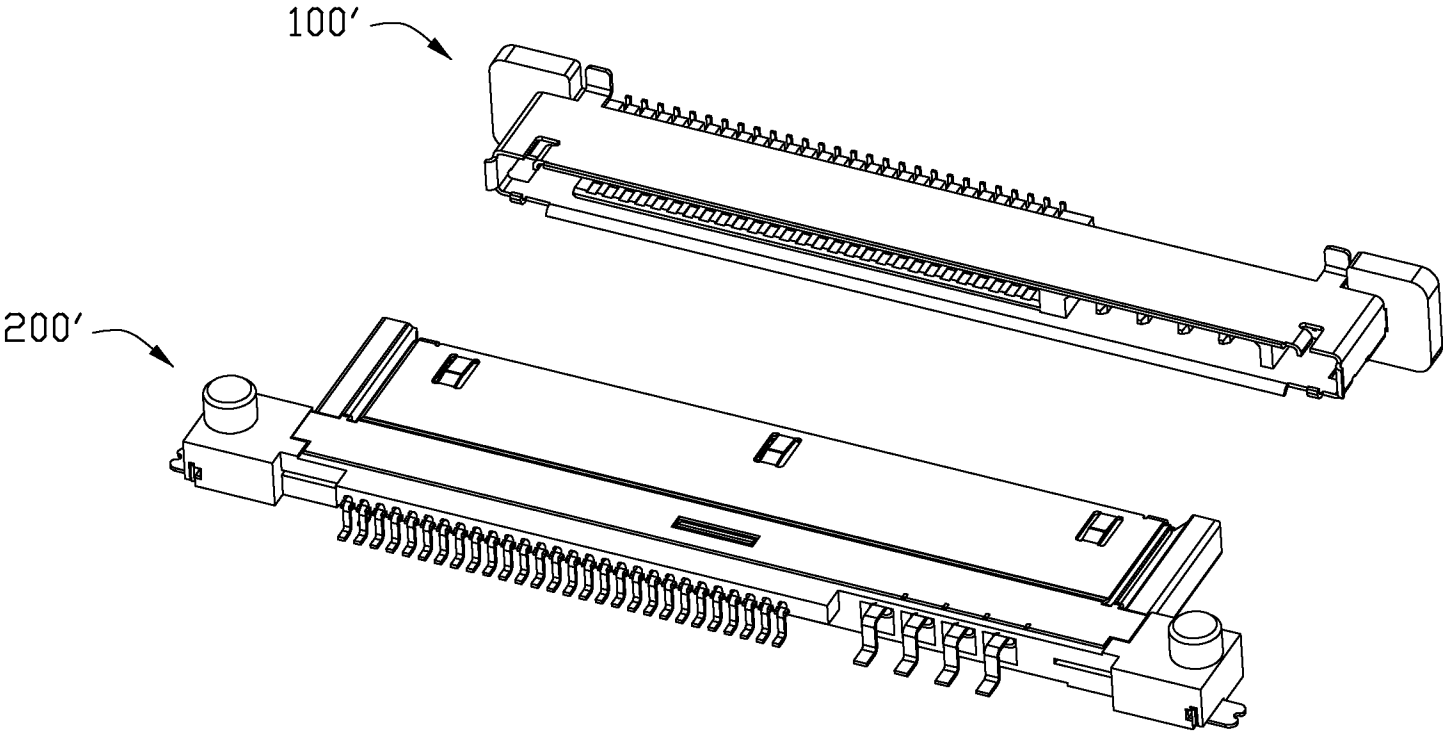
FIG. 11 is a perspective view of an electrical connector assembly of another embodiment in accordance with the present invention.

Referring to FIG. 9 and FIG. 10, when the first connector 100 mates with the second connector 200, each first guiding portion 411 is received in a corresponding first guiding slot 641 and slides in the first guiding slot 641, and each second guiding portion 412 is received in a corresponding second guiding slot 642 and slides in the second guiding slot 642, the first mating portion 62 is disposed between the first mating tongue 11 and the second mating tongue 12 to make the first contacts 21 mechanically and electrically contact with the first mating contacts 71. The second mating portion 63 extends into the mating room 104 to make the second contacting portions 221 project into the terminal holes 631 to be clipped by the clipping portions 722. The first strengthen arm 13 is received in the first receiving slot 65, and the second strengthen arm 14 is received in the second receiving slot 66. The guiding posts 64 each is received in a corresponding guiding room 105 with a free end projects into the receiving room 152. Referring to FIG. 2, the size of the first guiding portion 411 is equal to the size of the first guiding slot 641 in the longitudinal direction, and the first guiding slot 641 defines a stopping surface 6411 preventing the first guiding portion 411 from moving excessive to the second connector 200. Referring to FIG. 11, the size of the second guiding portion 412 is smaller than the size of the second guiding slot 642 in the longitudinal direction in a second embodiment of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing defining a base portion, a mating port extending forwardly along a front-to-rear direction from the base portion and a pair of guiding posts disposed at two opposite sides of the base portion, the mating port defining a front face perpendicular to the front-to-rear direction, the guiding post extending beyond the front face in the front-to-rear direction and defining upper and lower faces opposite in a vertical direction perpendicular to the front-to-rear direction and an outer connecting face connecting the upper and lower faces;

a plurality of conductive terminals retained in the insulative housing and arranged in a longitudinal direction; and a shield shell enclosing the insulative housing; wherein each guiding post defines a first guiding slot selectively disposed on at least one face of the upper face, the lower face and the connecting face, and the first guiding slot is U-shaped and forwardly runs through a free end of the guiding post in the front-to-rear direction; wherein the shield shell defines a pair of base plates located on opposite sides of the mating port and a locking portion bending to the base portion, and during assembling the locking portion slides in the first guiding slot to be fixed to the base portion; wherein said locking portion is located around a boundary between the mating port and the base portion and rearwardly far away from the front face.

2. The electrical connector as described in claim 1, wherein each guiding post integrally connects with the mating port, the first guiding slot is disposed on the lower face, and a second guiding slot is disposed on the upper face at a joint of the upper face and the mating port, the second guiding slot runs through the guiding post in the front-to-rear direction.

3. The electrical connector as described in claim 2, wherein the height of each guiding post is larger than the height of the mating port in the vertical direction, and the first guiding slot defines a stopping surface therein.

4. The electrical connector as described in claim 1, wherein the shield shell defines a pair of connecting plates connecting the front edges of the first and second base plates at two side portion thereof, and each connecting plate abuts against the front face and adjacent to a guiding post.

5. The electrical connector as described in claim 4, wherein the mating port defines two holes running through the front face, the connecting plates each covers one of the two holes.

6. The electrical connector as described in claim 5, wherein the part of the guiding post located in front of the front face is a tapered shaped.

7. An electrical connector assembly, comprising:

a first connector defining a longitudinal first housing, a plurality of contacts and a metal shell, the metal shell surrounds the first housing to form a mating cavity and defines a first and a second side wall, a pair of first guiding portions bending and extending into the mating cavity from a front edge of the first side wall and a pair of second guiding portions ripped from the second side wall and projecting to the first side wall, the first and second guiding portions offset in a longitudinal direction and respectively disposed in two perpendiculars planar; and a second connector mating with the first connector along a front-to-rear direction and defining a second housing, a plurality of second contacts retained to the second housing and a mating shell enclosing the second housing, the second housing defining a mating port and a pair of guiding posts disposed at two opposite sides of the mating port in the longitudinal direction; wherein during mating, each guiding post defines a U-shaped first guiding slot extends along the front-to-rear direction to receptively guide the first guiding portion and a U-shaped second guiding slot extends along the front-to-rear direction to receptively guide the second guiding portion.

8. The electrical connector assembly as described in claim 7, wherein the size of the first guiding portion is equal to the size of the first guiding slot in the longitudinal direction, and the second guiding portion is smaller than the size of the second guiding slot in the longitudinal direction.

9. The electrical connector assembly as described in claim 7, wherein the mating shell encloses the mating port and defines two opposite base plates and a connecting plate connecting the two base plates, the connecting plate abuts against a front face of the mating port and adjacent to the guiding post.

10. An electrical connector assembly comprising:

a first connector including:

a first insulative housing extending along a longitudinal direction with a first mating port forwardly exposed to an exterior in a front-to-back direction perpendicular to said longitudinal direction;

a plurality of first contacts disposed in the first housing with first contacting sections exposed in the first mating port; and a first metallic shell enclosing and secured to the first housing; and forming a guiding portion along the front-to-back direction;

a second connector including:

a second insulative housing defining an elongated body in said longitudinal direction with a second mating port forwardly exposed to an exterior in the front-to-back direction;

a plurality of second contacts disposed in the second housing with second contacting sections exposed in the second mating port;

a second metallic shell enclosing the second housing; wherein the second housing defines a guiding slot around the second mating port in the front-to-back direction corresponding to the guiding portion of the first connector, and the second shell defines a locking portion dimensioned in compliance with the guiding slot to not only allow and guide the second shell to be rearwardly assembled to the second housing along the front-to-back direction but also lock the second shell to the second housing when said second shell is moved to a final securing position with regard to the second housing; wherein during mating, the guiding portion of the first shell of the first connector is receptively moved along the guiding slot of the second shell of the second connector for both anti-misorientation and guiding.

11. The electrical connector assembly as claimed in claim 10, wherein the locking portion extends in a folded manner from a forward edge of a rear portion of the second shell.

12. The electrical connector assembly as claimed in claim 10, wherein the guiding portion extends around a front edge of the first shell.

13. The electrical connector assembly as claimed in claim 12, wherein said guiding portion extends into the first mating portion along a vertical direction perpendicular to both said longitudinal direction and said front-to-back direction.

14. The electrical connector assembly as claimed in claim 10, wherein the second housing includes a guiding post at a longitudinal end to guide mating between the first connector and the second connector, and the guiding slot is formed adjacent to said guiding post.

15. The electrical connector assembly as claimed in claim 14, wherein said guiding post is exposed outside of the second shell in said longitudinal direction.

16. The electrical connector assembly as claimed in claim 15, wherein said first shell encloses said guiding post in said longitudinal direction.

17. The electrical connector assembly as claimed in claim 10, wherein said second housing further defines another guiding slot at a different longitudinal position with regard to said guiding slot, the second shell defines another locking portion moving along said another guiding slot during assembling, and the first shell defines another guiding portion moving along said another guiding slot during mating.

18. The electrical connector assembly as claimed in claim 17, wherein said guiding slot and said another guiding slot are located at opposite faces of the second housing.

19. The electrical connector assembly as claimed in claim 10, wherein the guiding slot defines a depth in a vertical direction perpendicular to both said front-to-back direction and said longitudinal direction.

* * * * *